US005482744A

United States Patent [19]

Pearson

[11] Patent Number: 5,482,744

[45] Date of Patent: Jan. 9, 1996

[54] PRODUCTION OF HEAT TRANSFER ELEMENT

[75] Inventor: Stephen F. Pearson, Bearsden, United Kingdom

[73] Assignee: Star Fabrication Limited, United Kingdom

[21] Appl. No.: 199,475

[22] Filed: Feb. 22, 1994

[51] Int. Cl.[6] ..... B06D 1/08

[52] U.S. Cl. ..... 427/455; 427/191; 427/192; 427/424; 427/427; 427/456

[58] Field of Search ..... 427/191, 192, 427/455, 456, 427, 424

[56] References Cited

U.S. PATENT DOCUMENTS

| | | | |
|---|---|---|---|
| 3,384,154 | 5/1968 | Milton | 62/527 |
| 4,075,376 | 2/1978 | Jaeger | 427/191 |
| 4,320,251 | 3/1982 | Narasimhan | 427/191 |
| 4,600,599 | 7/1986 | Wallsten | 427/424 X |
| 4,661,682 | 4/1987 | Gruner et al. | 219/121 PL |
| 4,753,849 | 6/1988 | Zohler | 427/449 |
| 4,877,645 | 10/1989 | Bleich | 427/424 |
| 5,302,414 | 4/1994 | Alkhimov | 427/191 |

FOREIGN PATENT DOCUMENTS

| | | | |
|---|---|---|---|
| 485194 | 5/1992 | European Pat. Off. | 427/456 |
| 2646554 | 4/1978 | Germany | 427/456 |
| 2163182 | 2/1986 | United Kingdom | 427/191 |
| 2241249 | 8/1991 | United Kingdom | 427/427 |
| WO8912115 | 12/1989 | WIPO | 427/455 |

*Primary Examiner*—Michael Lusignan
*Attorney, Agent, or Firm*—Gifford, Krass, Groh, Sprinkle, Patmore, Anderson & Citkowski

[57] ABSTRACT

A heat transfer element (2) for use in boiling a liquid is produced by spraying a substrate, such as a heat exchanger tube, with a plasma of liquified metal particles and concurrently spraying the substrate with liquid carbon dioxide to provide a cooling effect. Preferably the metal particle spray (4) and the carbon dioxide spray (8) are spaced apart, and there is relative movement between the sprays and the substrate, such that a given area of the substrate is precooled by the cold carbon dioxide just prior to liquified metal particles impinging thereon. A shroud (6) may assist in directing the liquid carbon dioxide first onto the substrate, then into the spray of liquified metal particles.

9 Claims, 3 Drawing Sheets

PRODUCTION OF HEAT TRANSFER ELEMENT

FIELD OF THE INVENTION

The present invention relates to a process for the production of a heat transfer element for boiling a liquid, to the heat transfer element produced in this way, and to an apparatus for carrying out the process.

BACKGROUND OF THE INVENTION

It is well known that the heat transfer co-efficient for boiling a liquid may be improved by coating the heat transfer surface of a heat exchanger with a matrix of small heat-conductive particles which produce a network of linked re-entrant cavities. The cavities act as nucleation centres for the production of bubbles of vapour.

So called "high flux" (trademark) tubing having a high co-efficient of heat transfer is available but its production is complex and the tubing is correspondingly expensive. High flux tubing is generally produced by coating a tube with petroleum jelly and depositing particles of a cupro-nickel powder onto the tube so that the particles become embedded in the petroleum jelly. The cupro-nickel powder is made up of two components having different melting points. The coated tube is then heated in a furnace to a temperature such that one of the components just melts and adheres the other non-melted powder to the tube. In this way, a matrix of metal particles firmly adhered to the tube is produced.

There have in the past been various attempts to provide a high heat transfer surface by plasma spraying liquified metal onto a substrate, but generally speaking, results have not been consistent.

European Patent application 88307468.4 describes a method of coating heat transfer surfaces by spraying a particulate mixture of metal and a plastics material onto a thermally conductive surface to form a coating comprising particles of plastics material embedded in metal, and heating to a temperature sufficient to volatilise the plastics material, thereby forming pores in the metal coating.

Our earlier European Patent application 91310265.3 describes the production of a surface coating comprising porous carbon particles embedded in a matrix of metal particles produced by plasma spraying a mixture of particles of metal and carbon onto a substrate in an inert gas atmosphere.

U.S. Pat. No. 3,384,154 describes a method of coating heat transfer surfaces with small metallic particles which are subsequently sintered onto the substrate material.

U.S. Pat. No. 4,753,849 describes a process of coating an evaporator tube which involves arc spraying two dissimilar metals onto the tube and then etching out one of the metals.

European application 80101983.7 describes the production of a porous boiling surface by spraying liquified aluminium onto a substrate under inert gas according to certain specified conditions.

SUMMARY OF THE INVENTION

The reasons why particular types of coating give high co-efficients of heat transfer are complex. The important parameters include particle size, pore size, range of pore sizes, activity of the particles, surface tension of the liquid being boiled and the angle of contact between liquid and particle surface in the presence of vapour.

Generally speaking, the present invention is based on the discovery that co-spraying liquified metal and liquid carbon dioxide results in a surface having good heat transfer properties.

Most specifically, the present invention provides a process for the production of a heat transfer element for boiling a liquid which comprises:

spraying a substrate with liquified metal particles; and concurrently spraying the substrate with liquid carbon dioxide;

such as to form a heat transfer element having a matrix of metal particles attached to the substrate. The invention also provides a corresponding apparatus.

The term "spraying" is to be interpreted broadly to include processes wherein substantially semi-solid or liquid metal is impacted onto a substrate.

Whilst the liquid carbon dioxide and metal may be sprayed onto the substrate from closely spaced adjacent locations (e.g. nozzles) it is preferred to move the substrate relative to the liquified metal spray (by moving the spray locations, the substrate, or both), such that the liquid carbon dioxide is sprayed onto a given area of the substrate slightly before the liquified metal particles impinge on that area of the substrate. This has the effect of pre-cooling the substrate and also cooling the liquified metal particles somewhat so that the particles may become skinned or semi-solid. In this way, the particles have sufficient adherent nature to adhere firmly to the substrate, yet are not so liquid that they flow and lose their particle-like nature when they hit the substrate.

It is particularly advantageous if the liquid carbon dioxide is sprayed into a shroud which directs the liquid carbon dioxide first onto the substrate and then the cold carbon dioxide is directed (usually sideways) into the spray of liquified metal particles.

Liquified carbon dioxide has been found to be uniquely effective in the practising of the invention. It is possible that some thermal decomposition of the carbon dioxide takes place leading to the production of carbon. However, this is merely a hypothesis and should not be used to limit the generality of the present invention. On spraying, the liquid carbon dioxide forms a powder which then vapourises to provide a cooling effect. The formation of the fine powder and its subsequent vapourisation may assist in the formation of pores in the matrix. Thus, it is found that the good results of the present invention are not obtained by spraying other liquids such as water, liquid nitrogen, or sulphur hexafluoride.

The metal particles are preferably formed of a heat conductive material such as aluminium or other high conductivity metal or alloy known in the art. The particle size is usually in the range 1 to 100 microns, particularly 10 to 60 microns, and the thickness of the layer is preferably less than 250 microns. Thus, on average, the layer will usually be about 2 to 5 metal particles deep.

Preferably, the substrate is grit-blasted prior to spraying. Usually, the substrate is in the form of a heat transfer tube but may also be a plate or other heat transfer element. The substrate is usually of metal, for example cupro-nickel, copper, steel or stainless steel. Generally, it is not possible to produce "high flux" tubing from stainless steel according to conventional technology.

The heat transfer element of the invention allows heat exchangers for boiling liquids to be fabricated, which have high co-efficients of heat transfer. The heat transfer element finds particular use in the refrigeration field.

BRIEF DESCRIPTION OF THE DRAWINGS

An embodiment of the invention will now be described by way of example only in conjunction with the attached drawings wherein.

DETAILED DESCRIPTION OF THE PREFERRED EMBODIMENTS

Figure 1:
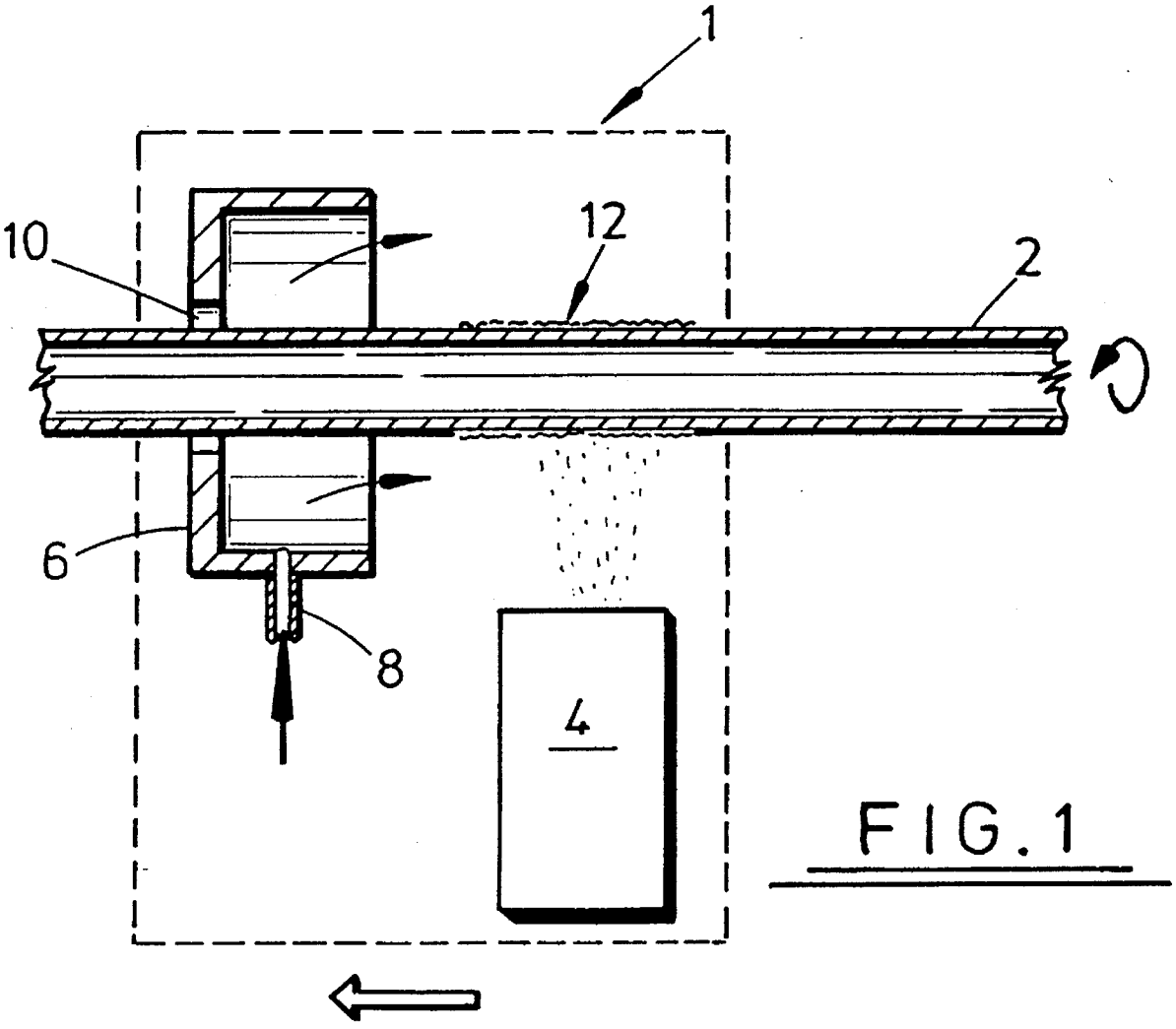
FIG. 1 is a schematic cross section through an arrangement used for carrying out the process of the present invention.

A heat transfer tube according to the invention was produced as follows. A cupro-nickel tube (90% copper and 10% nickel) was cleaned by grit blasting and was then mounted in the apparatus shown in FIG. 1. The tube 2 was mounted in a lathe for rotation about its longitudinal axis. Around the tube is mounted a spraying device 1 which is arranged so as to be moveable along the length of the tube in the direction indicated by the arrow for concurrently spraying the tube with metal particles and liquid carbon dioxide. It comprises a plasma spray gun 4, equipped for spraying aluminium metal in a flow of inert gas onto the tube, and a shroud 6 having a central aperture 10 for receiving the tube and an inlet nozzle 8 for spraying liquid carbon dioxide into the shroud and onto the tube. The shroud is arranged slightly upstream of the plasma spray of aluminium particles, such that the liquid carbon dioxide first cools the pipe surface and then exits from the shroud in a direction towards the plasma spray, so that the cold carbon dioxide then cools the plasma spray also. The flow rate of liquid carbon dioxide and the spacing of the shroud from the plasma stream is chosen such as to provide good adhesion of the aluminium metal particles 12 to the tube surface and to provide a high co-efficient of heat transfer.

The coating of aluminium particles was typically around 100 microns thick.

Figure 2:
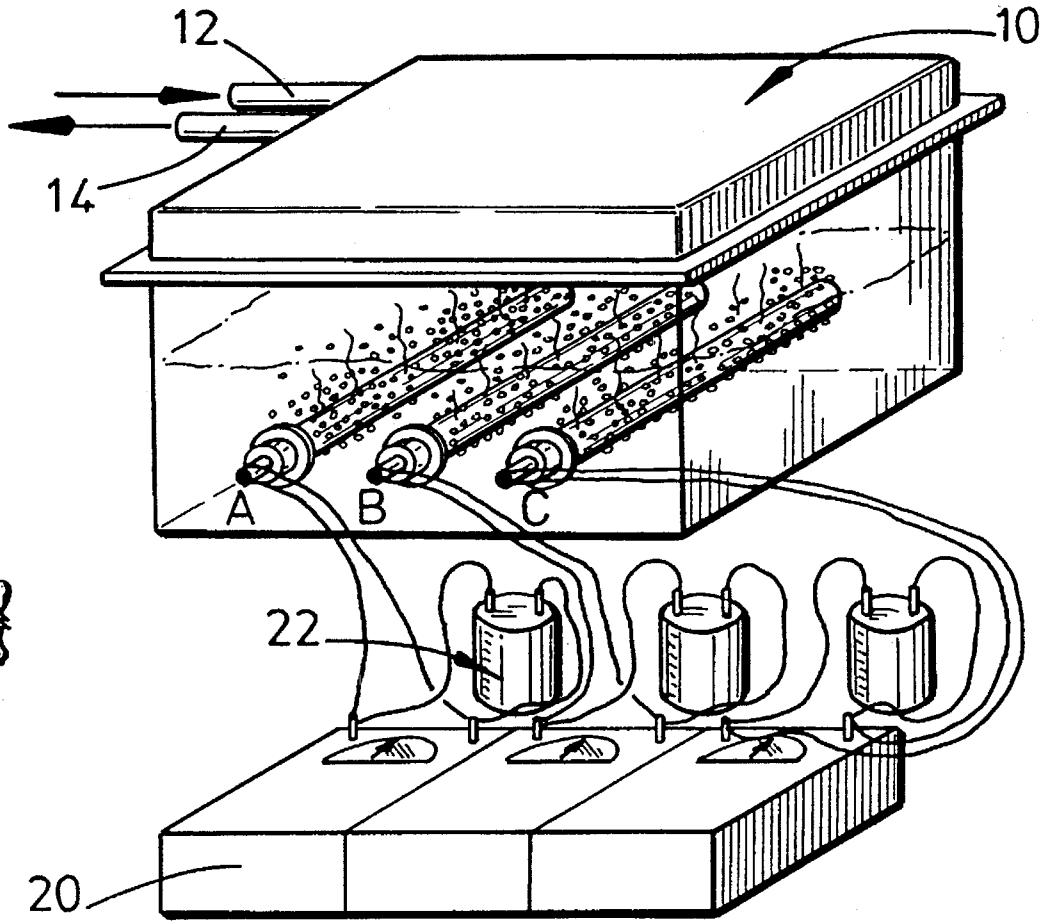
FIG. 2 is a test rig for comparing the heat conductivity of a tube B according to the invention with two other tubes for comparison.
Figure 3:
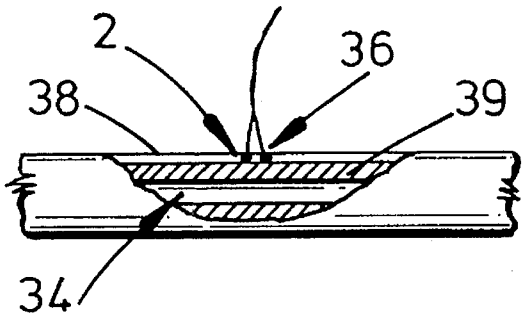
FIG. 3 is a cut away section through a heat transfer tube equipped with a heater for use in the test rig.

The heat transfer ability of the tube was then tested in an apparatus as shown in FIGS. 2 and 3. The heat transfer tube 2 was fitted with a heater 34 as shown in FIG. 3, and a low melting point alloy Ostalloy 158 (trademark) was poured into the space 39 between the heater and the tube to provide good thermal contact. The tube was equipped with a surface thermocouple pair 36 to measure the temperature at the surface of the tube.

FIG. 2 shows a test rig for measuring temperature difference between the tube surface and a boiling liquid, in this case refrigerant R11 (trichlorofluoromethane). A sealed container 10 is filled with liquid R11. The surface temperature of the tube is measured by thermocouple 36 and the temperature of the refrigerant R11 measured by a series of thermocouples (not shown) placed in the bulk of the liquid. The liquid is boiled by three heated tubes A, B and C each equipped with a heater and variable power supply. Each power supply is fed through a varistor 22. A watt meter 20 is fitted to measure the power drawn by the heater. The vapour produced is condensed using cooling water supplied to a cooler via inlet 12 and returned via outlet 14.

Heat transfer tube B is provided with an aluminium particle coating according to the invention, as described above. Tube A is a shot blasted cupro-nickel tube, and tube C is a high flux tube, for comparison purposes. The temperature difference between the tube surface and the R11 liquid was measured.

Figure 4:
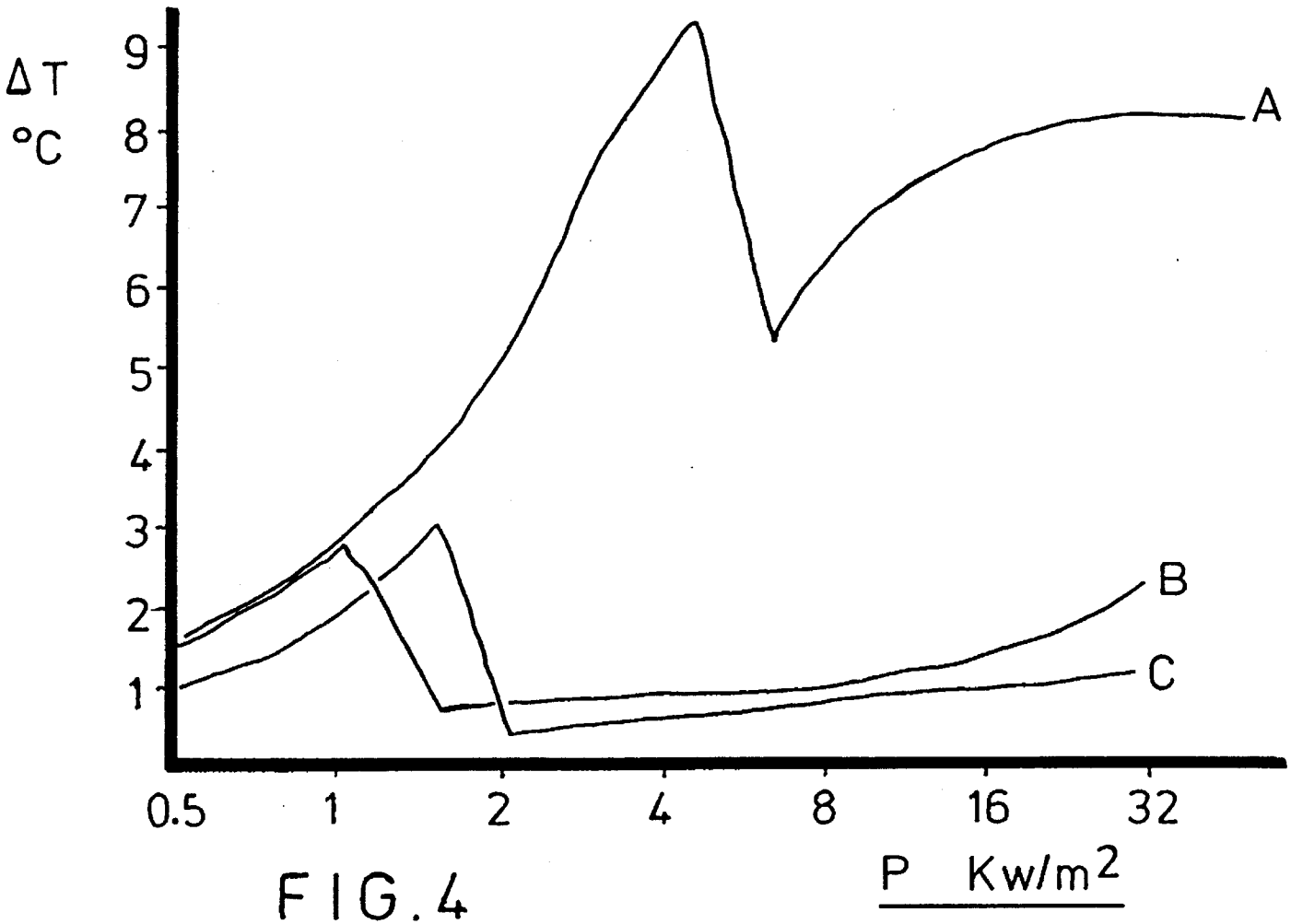
FIG. 4 is a graph of temperature difference (delta T) verses power P for the three tubes.

FIG. 4 shows the test results. The shot blasted cupro-nickel tube A shows a temperature difference of typically around 6° to 9° C. depending on the power. The temperature difference of the tube B according to the present invention is relatively low, indicated good heat transfer, and is comparable to the conventional high-flux tube C. However, the tube of the present invention is simpler and cheaper to produce.

I claim:

1. A process for the production of a heat transfer element for boiling a liquid which comprises:

spraying a substrate with molten metal particles; and concurrently spraying the substrate with liquid carbon dioxide;

to form a heat transfer element having a matrix of metal particles attached to the substrate.

2. A process according to claim 1 wherein the liquid carbon dioxide is sprayed onto a given area of the substrate such that the substrate is precooled before molten metal particles are sprayed onto said area.

3. A process according to claim 2 wherein the liquified metal particles and the liquid carbon dioxide are sprayed onto the substrate from spaced adjacent locations, the substrate being moved relative to the liquified metal spray; such that the liquid carbon dioxide is sprayed onto a given area of the substrate before the molten metal particles.

4. A process according to claim 3 wherein the liquid carbon dioxide is sprayed into a shroud which directs the .liquid carbon dioxide first onto the substrate to cool the substrate, and then in a direction toward the spray of molten metal particles.

5. A process according to claim 1 wherein the substrate is in the form of a tube.

6. A process according to claim 1 wherein the substrate is formed of a metal selected from the group consisting of cupro-nickel, copper, steel and stainless,steel.

7. A process according to claim 1 wherein the metal particles are formed of aluminium.

8. A process according to claim 1 wherein the matrix of metal particles has a thickness less than 250 microns.

9. A process according to claim 1 wherein the molten metal particles have a particle size in the range 10 to 60 microns.

* * * * *